United States Patent [19]

Schlicht et al.

[11] Patent Number: 4,729,769

[45] Date of Patent: Mar. 8, 1988

[54] GASOLINE COMPOSITIONS CONTAINING REACTION PRODUCTS OF FATTY ACID ESTERS AND AMINES AS CARBURETOR DETERGENTS

[75] Inventors: Raymond C. Schlicht, Fishkill; Mark D. Levin, Poughkeepsie; Sheldon Herbstman, New City; Rodney L. Sung, Fishkill, all of N.Y.

[73] Assignee: Texaco Inc., White Plains, N.Y.

[21] Appl. No.: 861,196

[22] Filed: May 8, 1986

[51] Int. Cl.[4] ..... C10L 1/14

[52] U.S. Cl. ..... 44/71; 44/66

[58] Field of Search ..... 44/71, 66

[56] References Cited

U.S. PATENT DOCUMENTS

| | | | |
|---|---|---|---|
| 1,692,784 | 11/1928 | Orelup et al. | 44/71 |
| 2,103,872 | 12/1937 | Schoeller et al. | 260/404.5 PA |
| 4,344,771 | 8/1982 | Bonazza et al. | 44/63 |
| 4,428,754 | 1/1984 | Smith | 44/53 |

*Primary Examiner*—William R. Dixon, Jr.
*Assistant Examiner*—Cynthia A. Prezlock
*Attorney, Agent, or Firm*—Robert A. Kulason; James J. O'Loughlin; Carl G. Seutter

[57] ABSTRACT

Improved gasolines contain, as a detergent additive, the reaction product of coconut oil and diethanolamine or dimethylaminopropylamine.

25 Claims, No Drawings

GASOLINE COMPOSITIONS CONTAINING REACTION PRODUCTS OF FATTY ACID ESTERS AND AMINES AS CARBURETOR DETERGENTS

FIELD OF THE INVENTION

This invention relates to a fuel composition for internal combustion engines particularly characterized by detergency properties. More particularly it relates to a novel gasoline composition containing a carburetor detergency additive.

BACKGROUND OF THE INVENTION

As is well known to those skilled in the art, contemporary internal combustion engines are increasingly characterized by admission to the intake of the carburetor of (i) blow-by gases from the crankcase of the engine and (ii) exhaust gases from the combustion chamber—these design changes being intended to minimize discharge of undesirable gases to the atmosphere. However, these gases commonly contain significant amounts of materials which deposit in and around the throttle plate area of the carburetor resulting in decreased air flow through the carburetor, particularly at low speeds; and an over-rich fuel mixture is formed. This is responsible for stalling or rough engine idling whch undesirably increases the amount of polluting gas emissions.

It is an object of this invention to provide a fuel composition characterized by improved detergency properties. Other objects will be apparent to those skilled in the art.

STATEMENT OF THE INVENTION

In accordance with certain of its aspects, this invention is directed to a motor fuel composition comprising a motor fuel composition comprising (a) a major portion of a fuel containing a hydrocarbon boiling in the gasoline range; and (b) a minor effective amount of, as detergent additive, a reaction product of a $C_6$–$C_{20}$ fatty acid ester and a mono- or di-(hydroxy hydrocarbonyl) amine.

In accordance with certain of its aspects, this invention is directed to a motor fuel composition comprising (a) a major portion of a fuel containing a hydrocarbon boiling in the gasoline range; and (b) a minor effective amount of, as detergent additive, fatty acid amide.

$$RC\overset{O}{\overset{\|}{N}}(R''OH)_{2-a}(H)_a$$

wherein

R is an alkyl hydrocarbon group containing 6–20 carbon atoms;

R'' is a divalent alkylene hydrocarbon group containing 1–10 carbon atoms;

a is 0 or 1.

DESCRIPTION OF THE INVENTION

The base fuel in which the additive of the invention may be used to form a motor fuel composition may comprise a mixture of hydrocarbons boiling in the gasoline boiling range. This base fuel may contain straight chain or branched chain paraffins, cycloparaffins, olefins, and aromatic hydrocarbons and any mixture of these.

The base fuel may be derived from straight-chain naphtha, polymer gasoline, natural gasoline, catalytically cracked or thermally cracked hydrocarbons, catalytically reformed stocks, etc. It may typically boil in the range of about 80°–450° F. Any conventional motor fuel base may be employed in the practice of this invention.

The fuel composition of the invention may contain any of the additives normally employed in a motor fuel. For example, the base fuel may be blended with anti-knock compounds, such as tetraalkyl lead compounds, including tetraethyl lead, tetramethyl lead, tetrabutyl lead, etc or cyclopentadienyl manganese tricarbonyl, generally in a concentration from about 0.05 to 4.0 cc. per gallon of gasoline. The tetraethyl lead mixture which is commercially available for automotive use contains an ethylene chloride-ethylene bromide mixture as a scavenger for removing lead from the combustion chamber in the form of a volatile lead halide. The motor fuel composition may also be fortified with any of the conventional additives including anti-icing additives, corrosion-inhibitors, dyes, etc.

In accodance with practice of this invention, there may be added to a major portion of the fuel, a minor effective amount of, as detergent additive, a reaction product of a $C_6$–$C_{20}$ fatty acid ester and a mono- or di-hydroxy hydrocarbon amine.

The acid moiety may preferably be RCO- wherein R is preferably an alkyl or alkenyl hydrocarbon group containing 5–19 carbon atoms typified by caprylic, caproic, capric, lauric, myristic, palmitic, stearic, oleic, linoleic, etc. Preferably the acid is saturated although unsaturated acid may be present.

Preferably the reactant bearing the acid moiety may be natural oil: coconut, babassu, palm kernel, palm, olive, castor, peanut, rape, beef tallow, lard, lard oil, whale blubber, sunflower, etc. Typically the oils which may be employed will contain several acid moieties, the number and type varying with the source of the oil.

The acid moiety may be supplied in a fully esterified compound or one which is less than fully esterified eg glyceryl tri-stearate, glyceryl di-laurate, glyceryl mono-oleate, etc. Esters of polyols, including diols and polyalkylene glycols may be employed such as esters of mannitol, sorbitol, pentaerythritol, polyoxyethylene polyol, etc.

The mono- or di-(hydroxyhydrocarbon) amine which may be reacted to form the products of this invention may be a primary or secondary amine which possess a hydroxy group. Typically it may be characterized by the formula $$HN(R''OH)_{2-a}H_a$$

Typical amines may include the following:

TABLE ethanolamine
diethanolamine
propanolamine
isopropanolamine
dipropanolamine
di-isopropanolamine
butanolamines etc.

Reaction may be effected by heating the oil and the amine in equivalent quantities to produce the desired product. Clearly if a diamine or a polyamine (eg a triamine) be employed, the equivalent amount may be onehalf or one-third the equivalent for a mono-amine. Reaction may typically be effected by maintaining the reactants at 100° C.–200° C., say 120° C.–150° C. for 1–10 hours, say 4 hours. Reaction may be carried out in solvent, preferably one which is compatible with the ultimate composition in which the product is to be used.

The reaction may be as follows:

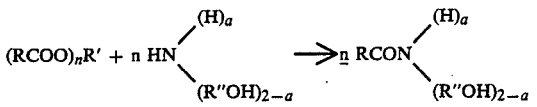

wherein R′ is hydrogen or a hydrocarbon residue of an alcohol i.e. a hydrocarbon which may be alkyl, alkaryl, aralkyl, cycloalkyl, aryl, etc. The designation alkyl, for example is intended to embrace groups derived from alkanes having n free valence bonds wherein n is 1–10 e.g. glyceryl ($C_3H_5$) having three free valence bonds. R′ is preferably a residue of glycerine i.e. $(HO)_nR'$ is preferably glycerine $C_3H_5(OH)_3$.

a is 0 or 1. R″ is a divalent hydrocarbon group, preferably a lower ($C_1$–$C_{10}$) alkylene group. R is an alkyl, alkaryl, aralkyl, cycloalkyl, alkenyl, or aryl hyrocarbon group.

Typical reaction products which may be employed in practice of this invention may include those formed from esters having the following acid moieties and alkanolamines:

TABLE

| Acid Moiety in Ester | Amine |
|---|---|
| Lauric Acid | propanolamine |
| Lauric Acid | diethanolamine |
| Lauric Acid | ethanolamine |
| Lauric Acid | dipropanolamine |
| Palmitic Acid | diethanolamine |
| Palmitic Acid | ethanolamine |
| Stearic Acid | diethanolamine |
| Stearic Acid | ethanolamine |

Other useful mixed reaction products with alkanolamines may be formed from the acid component of the following oils: coconut, babassu, palm kernel, palm, olive, castor, peanut, rape, beef tallow, lard, whale blubber, corn, tall, cottonseed, etc.

In one preferred aspect of this invention, the desired reaction product may be prepared by the reaction of (i) a fatty acid ester of a polyhydroxy compound (wherein some or all of the OH groups are esterified) and (ii) diethanolamine.

Typical fatty acid esters may include esters of the fatty acids containing 6–20 preferably 8–16, say 12 carbon atoms. These acids may be characterized by the formula RCOOH wherein R is an alkyl hydrocarbon group containing 7–15, preferably 11–13 say 11 carbon atoms.

Typical of the fatty acid esters which may be employed may be the following:

TABLE glyceryl tri-laurate
glyceryl tri-stearate
glyceryl tri-palmitate
glyceryl di-laurate
glyceryl mono-stearate
ethylene glycol di-laurate
pentaerythritol tetra-stearate
pentaerythritol tri-laurate
sorbitol mono-palmitate
sorbitol penta-stearate
propylene glycol mono-stearate The esters may include those wherein the acid moiety is a mixture as is typified by those found in natural oils typified by the following oils:

TABLE

Coconut
Babassu
Palm kernel
Palm
Olive
Caster
Peanut
Rape
Beef Tallow
Lard (leaf)
Lard Oil
Whale blubber The preferred ester is coconut oil which contains the following acid moieties:

TABLE

| Fatty Acid Moiety | Wt. % |
|---|---|
| Caprylic | 8.0 |
| Capric | 7.0 |
| Lauric | 48.0 |
| Myristic | 17.5 |
| Palmitic | 8.2 |
| Stearic | 2.0 |
| Oleic | 6.0 |
| Linoleic | 2.5 |

When the additive is to be prepared in manner to decrease the cost, the charge composition includes the reaction product of (i) preferably a natural oil ester such as coconut oil, as the source of the acid moiety, and (ii) an amine $$HN(R''A)_{2-a}H_a$$

typfied by those noted supra such as diethanolamine.

The amine may be present in equivalent amount e.g. one mole of amine per one acid moiety in the reacting ester. In this instance, the ester will be essentially completely consumed; and the by-product may be e.g. glycerine. Alternatively the amine may be present in lesser amount in which case the product mixture will contain lesser amounts of the desired amide together with, as by-products (in the preferred embodiment), glyceryl mono-cocoate and glyceryl di-cocoate. (the coconate moiety is the mixture of acid moieties contained in coconut oil). It is an advantage of this aspect of the invention that the product mixture containing e.g. the mono- and di-esters of glycerine, will thereby contribute dispersancy to the product mix—which may be advantageous in the fuel composition.

Reaction may be carried out preferably by heating the oil and the amine at 80° C.–120°, say 120° C. for 2–8 hours, say 4 hours and the reaction mixture is polish filtered hot.

Reaction may typically be (in the case of equivalent amounts):

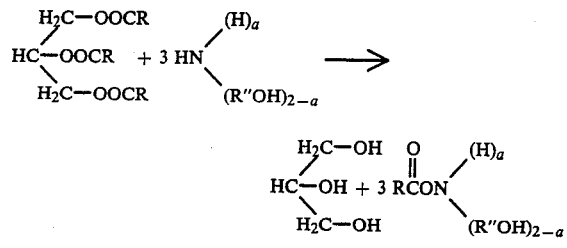

In one embodiment where the amount of ethanolamine is less than the equivalent amount, the reaction may be:

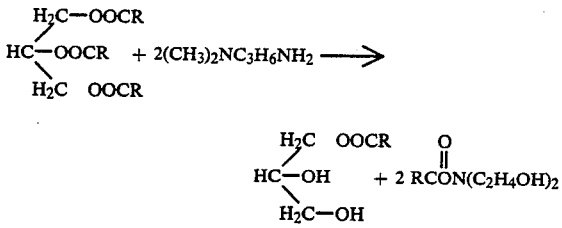

Thus in addition to the additive fatty acid amide the reaction product may also contain:

(i) the by-product hydroxyl compound typified by glycerine;

(ii) the by-product mono-ester of the charge oil typified by glyceryl mono-cocoate;

(iii) the by-product di-ester of the charge oil typified by glyceryl di-cocoate;

(iv) the charge amine (if an excess be employed); etc.

The reaction mixture may also contain esters wherein one or more of the hydroxy groups of the amine have reacted with the acid and also ester-amides in which both ester and amide groups are formed.

In accordance with practice of this invention according to one of its aspects, there may be added to a major portion of the fuel, a minor effective amount of, as detergent additive, a mixture containing fatty acid amide and glyceryl partial esters obtained by the reaction of a glyceryl ester and an alkanolamine $$RCON(R''OH)_{2-a}(H)_a$$

wherein

R is an alkyl, alkaryl, aralkyl, cycloalkyl, aryl, and alkenyl hydrocarbon group containing 6–20 carbon atoms;

R'' is a divalent alkylene hydrocarbon group containing 1–10 carbon atoms; and a is 0 or 1.

In the above formula, R may be a hydrocarbon group selected from the group consisting of alkyl, aralkyl, cycloalkyl, aryl, alkaryl, and alkenyl including such radicals when inertly substituted. When R is alkyl, it may typically be hexyl, octyl, decyl, octadecyl, etc. When R is aralkyl, it may typically be beta-phenyl, etc. When R is cycloalkyl, it may typically be cyclohexyl, cycloheptyl, cyclooctyl, 2-methylcycloheptyl, 3-butylcyclohexyl, 3-methylcyclohexyl, etc. When R is aryl, it may typically be phenyl, naphthyl, etc. When R is alkaryl, it may typically be tolyl, xylyl, etc. When R is alkenyl, it may typically be octadecenyl, etc. When R may be inertly substituted i.e. it may bear a non-reactive substituent such as alkyl, aryl, cycloalkyl, ether, etc. Typically inertly substituted R groups may include ethylhexyl, methyl nonyl, 4-methylcyclohexyl, etc. The preferred R groups may contain 6–20, preferably 8–16, say 12 carbon atoms.

These by-products need not be separated. The reaction product may be employed as is as additive.

In practice of this invention according to certain of its aspects, the additive may be added to the base fuel in minor effective amount. The additives are particularly effective in amount of 0.002–0.2w% (ca 0.6–64 PTB) of the total fuel composition. Preferred range may be 0.008–0.1 w%, (ca 2.7–34 PTB) more preferrable 0.02–0.08 w%, (ca 6.4–27 PTB) say 0.06 w% (ca 20 PTB). PTB stands for pounds per thousand barrels.

It is a feature of this invention that the fuel composition as prepared is characterized by improved carburetor detergency, as tested by the Carburetor Detergency Test—Phase III.

CARBURETOR DETERGENCY TEST—PHASE III

This test is run on a Chevrolet V-8 engine mounted on a test stand using a modified four barrel carburetor. The two secondary barrels of the carburetor are sealed; and the feed to each of the primary barrels is arranged so that simultaneously an additive fuel can be run in one barrel and the reference fuel run in the other. The primary carburetor barrels are modified so that they have removable aluminum inserts (sleeves) in the throttle plate area in order that deposit formed on the inserts in this area can be conveniently weighed.

An unleaded base fuel is first charged to both of the primary barrels and a layer of deposit thus built up on the inserts over 48 hours. The inserts are removed, weighed, and then replaced.

The test proper is then started by charging to one barrel a reference fuel which serves as a standard. The test fuel is admitted to the other barrel of the carburetor.

The engine is run as the feed is admitted to both barrels; engine blow-by is circulated to an inlet in the carburetor body. The test continues for 48 hours.

At the conclusion of the test, the inserts are removed from the carburetor and weighed to determine the difference between the performance of the additive and reference fuels in removing the preformed deposits.

After the aluminum inserts are cleaned, they are replaced in the carburetor and the process is repeated. First the base fuel is used in both barrels to lay down a predeposited layer and then the reference fuel and the test fuel are admitted. In this second portion of the test, the reference fuel is admitted to the barrel to which the test fuel was admitted during the first portion of the test; and the test fuel is admitted to the barrel to which the reference fuel was admitted during the first portion of the test. The test continues for 48 hours.

This minimizes effects due to differences in fuel distribution and barrel construction.

The deposit weights in the two portions are averaged; and the effectiveness of the fuel composition of the invention is compared to the reference fuel which contains an effective detergent additive. The results are expressed as % removal of the milligrams of deposit previously built up.

The base fuel employed with the detergent additive of the invention in the following examples was a premium grade gasoline having a Research Octane Number of 99. This gasoline consists of about 23% aromatic hydrocarbons, 9% olefinic hydrocarbons and 68% paraffinic hydrocarbons and boiled in the range from 90° to 375° F. The reference fuel contains 60 PTB of a standard prior art carburetor detergent and corrosion inhibitor in the base fuel.

The compositions of this invention are found to show improved ability to serve in gasolines as a carburetor detergent when measured by (i) the Chevrolet Carburetor Detergency Test (CCDT III) or (ii) the Buick Intake System Deposit (ISD) Test. In the CCDT III Test, ratings are recorded as differences between the standard and the experimental; and a difference of less than 15 indicates substantially equivalent samples. Comparative runs using the experimental detergent in amount equal to three times as much of the control additive show substantially equivalent performance.

Products of this invention show improved performance in the ISD Test.

Buick Intake System Deposit Test (ISD)

The effect on carburetor detergency of the fuel composition of the invention may be determined in the Buick Intake System Deposit Detergency (ISD) Test. This is an 88 hour cycling test used to study the effect of fuel upon intake valve deposits.

A 1964 Buick (425 Cubic Inch Displacement engine using the standard production carburetor and Positive Crankcase Ventilation Valve and no oil filter) is installed on an dynamometer test stand with the necessary equipment to control speed, load, and engine temperatures. A standard fully formulated Havoline Motor Oil 10W-40 is used for fuel testing.

Prior to each run, the cylinder heads are completely reconditioned and new intake valves are installed. Special care is taken to assure that the inlet valve-to-valve guide clearance is maintained between 0.0035 to 0.0045 inches; and valve seat widths are maintained between 3/64 and 5/64 inches.

Upon completion of a run, the cylinder heads and valves are removed; and the valves are visually rated for the extent of deposit build-up on the valve tulip surface. The weight of intake valve deposits is also determined by subtracting the original valve weight from the final valve weight with deposits. The rust formations on the intake system cylinder head, intake manifold, and carburetor passages) are given a descriptive rating.

In the ISD test, the ratings are on scale of 0–10 and a rating above about 5 is satisfactory. The products of this invention show ratings of 6.5–8.5 using only 20–25% as much as additive as employed with prior art additives to attain the same ratings.

Products of this invention also show excellent corrosion inhibition properties when measured by the NACE Test.

Natural Association of Corrosion Engines Test (NACE)

The corrosive nature of the formulations may be tested by the NACE Rusting Test of the National Association of Corrosion Engineers. In this test, a mixture of 300 ml of test fuel and 30 ml distilled water is stirred at 100° F. (37.8° C.) with a steel specimen completely immersed therein for a test period of four hours. The percentage of the specimen that has rusted is noted.

When subjected to the NACE test. the motor fuel compositions of this invention generally show a rating of trace-to 1% rust.

Commonly it is found that 30–40 PTB of the system of this invention shows satisfactory performance.

The products of this invention also give satisfactory results in the Waring Blender Test.

The Waring Blender Test

In this test, a mixture consisting of 95 percent test gasoline and 5 percent test water is mixed at approximately 13,000 rpm for 10 seconds in an explosion proof Waring blender. The mixture is transferred to a graduated cylinder, and allowed to stand for hours. The appearance of the water layer is observed visually and the haze of the gasoline layer is measured with a haze meter. Readings on this meter of about 100 or less are acceptable.

DESCRIPTION OF PREFERRED EMBODIMENTS

Practice of this invention will be apparent to those skilled in the art from the following examples wherein, as elsewhere in this specification, all parts are parts by weight unless otherwise specified.

EXAMPLE I

In this example which represents the best mode known of carrying out the process of this invention, crude coconut oil (525.6 g—0.8 moles) is heated to about 60° C. Diethanolamine (151.2 g—1.44 moles) is added with stirring. The mixture is heated under nitrogen to 120° C. and held at 120° C. for 4 hours and then polish-filtered at 100°–120° C. Analysis shows 2.92% N (PE), 5.6 TAN (ASTM D-974), and 12.0 TBN (ASTM D-664).

EXAMPLE II

The procedure of Example I is followed employing 26.7 g (0.4 mole) of coconut oil and 73.44 g (0.72 mole) of dimethylaminoproplamine.

The product contained 5.73 w% nitrogen and had an acid number TAN of 12.7 and a base number TBN of 117.5.

Results comparable to those of Examples I–II may be obtained if the reactants are as follows:

TABLE

| Example | Oil | Amine |
|---|---|---|
| II | Corn Oil | ethanolamine |
| III | Peanut Oil | diethanolamine |
| IV | Soya Oil | diethanolamine |
| V | Palm Oil | ethanolamine |
| VI | Olive Oil | propanolamine |

EXAMPLES VII–VIII*

In these Examples, the product of Example I is compared to a standard commercial premium Fuel Detergent Additive. Specifically in Example VII, 20 PTB of the product of Example I in a standard gasoline is tested in the Chevrolet Carburetor Detergency Test (CCDT III). In control Example VIII, 60 PTB of the Premium Fuel Detergent Additive is tested in the same test. A difference from the control rating of less than 15 is acceptable.

TABLE

| Example | Parts | Additive | Difference from Control Rating |
|---|---|---|---|
| VII | 20 | Example I | −7 |

TABLE-continued

| Example | Parts | Additive | Difference from Control Rating |
|---|---|---|---|
| VIII* | 60 | control | |

The results indicate that 20 PTB of the product of Example I of this invention may be about equivalent to about 60 PTB of the control composition of Example VIII*.

EXAMPLE IX-XII*

In this series of Examples, various formulations were subjected to the Buick ISD Test and the following Merit Ratings were noted:

TABLE

| Example | Formulation | Merit Rating |
|---|---|---|
| IX* | Unleaded Base Fuel | 3–4 |
| X | 15 PTB of the product of Example I | 6.6 |
| XI | 60 PTB of a standard commercial carburetor detergent | 8.0 |
| XII* | 76 PTB of another standard commercial carburetor detergent | 6.1 |

From the above table, it is apparent that 15–20 PTB of the product of this invention is equivalent to 60–76 PTB of prior art standard products.

Results comparable to those of Examples IX–XII may be attained if the additive is:

TABLE

| Example | Additive of Examples |
|---|---|
| XIII | II |
| XIV | III |
| XV | IV |
| XVI | V |
| XVI | VI |

EXAMPLE XVIII

In this Example, the product of Example I is made into an additive package containing:

TABLE

| Component | Parts by Weight |
|---|---|
| Product of Example I | 75 |
| The Emery 955 Dimer Acid brand of the dimer (ca 600 mwt) of linoleic acid | 5 |
| Petrox brand of Carrier Oil | 20 |

In separate test in a standard unleaded fuel, 30 PTB and 40 PTB of the above additive package gives a pass in the NACE Corrosion Test.

The additive package, when present in the standard unleaded gasoline showed the following results after 4 hours in the Waring Blender Emulsion Test which evaluates the tendency of motor gasoline to form emulsion or haze with various water bottoms and to examine the stability fo such haze or emulsion.

Comparative results at different pH values are as follows (a rating of 100 or less is acceptable):

TABLE

| pH | Rating |
|---|---|
| 5 | 12 |
| 12 | 10 |
| distilled water | 4 |

The additive package shows excellent water separation properties and demonstrates no tendency to form emulsions.

Although this invention has been illustrated by reference to specific embodiments, it will be apparent to those skilled in the art that various changes and modifications may be made which clearly fall within the scope of this invention.

What is claimed is:

1. A motor fuel composition comprising (a) a major portion of a fuel consisting essentially of a hydrocarbon boiling in the gasoline boiling range; and (b) a minor effective amount of, as detergent additive, a reaction product of $C_6$–$C_{20}$ fatty acid ester and a mono- or di-(hydroxy hydrocarbyl) amine.

2. A motor fuel composition as claimed in claim 1 wherein said fatty acid is a $C_8$–$C_{16}$ fatty acid.

3. A motor fuel composition as claimed in claim 1 wherein said fatty acid is a $C_{12}$ fatty acid.

4. A motor fuel composition as claimed in claim 1 wherein said hydrocarbyl is a lower alkyl group.

5. A motor fuel composition as claimed in claim 1 wherein said amine is monoethanolamine.

6. A motor fuel composition as claimed in claim 1 wherein said amine is diethanolamine.

7. A motor fuel composition as claimed in claim 1 wherein said fuel is a gasoline.

8. A motor fuel composition as claimed in claim 1 wherein said additive is present in minor effective amount of 0.002–0.2 w%.

9. A motor fuel composition as claimed in claim 1 wherein said additive is present in minor effective amount of 0.002 w%–0.08 w%.

10. A motor fuel composition comprising:

(a) a major portion of a fuel consisting essentially of a hydrocarbon boiling in the gasoline boiling range; and (b) a minor effective amount of, as detergent additive, a reaction product of an N-hydroxyhydrocarbyl substituted amine and a polyol ester bearing $C_6$–$C_{20}$ acid moieties.

11. A motor fuel composition as claimed in claim 10 wherein said acid moieties are $C_8$–$C_{16}$ moieties.

12. A motor fuel composition as claimed in claim 10 wherein said acid moieties are $C_{12}$–$C_{14}$ moieties.

13. A motor fuel composition as claimed in claim 10 wherein said amine is an N-(hydroxyhydrocarbyl) amine and said ester bears $C_6$–$C_{20}$ acid moieties.

14. A motor fuel composition as claimed in claim 10 wherein said amine is an N-(beta-hydroxyethyl) amine and said polyol ester bears $C_6$–$C_{20}$ acid moieties.

15. A motor fuel composition as claimed in claim 10 wherein said amine is an N,N (bis)-(beta-hydroxyethyl) amine and said polyol ester bears $C_6$–$C_{20}$ acid moieties.

16. A motor fuel composition comprising:

(a) a major portion of a fuel consisting essentially of a hydrocarbon boiling in the gasoline boiling range; and (b) a minor effective amount, of, as detergent additive, a reaction product of $C_6$–$C_{20}$ fatty acid ester of a polyhydroxy compound and a mono- or di-(hydroxyhydrocarbyl) amine.

17. A motor fuel composition as claimed in claim 16 wherein said amine is monoethanolamine.

18. A motor fuel composition as calimed in claim 16 wherein said amine is diethanolamine.

19. A motor fuel composition comprising (a) a major portion of a fuel consisting essentially of a hydrocarbon boiling in the gasoline boiling range; and (b) 0.002 w%–0.2 w% of the reaction product of coconut oil and diethanolamine.

20. A motor fuel composition comprising (a) a major portion of a fuel consisting essentially of a hydrocarbon boiling in the gasoline boiling range; and (b) a minor effective amount of, as detergent additive, a reaction product of a $C_6$–$C_{20}$ fatty acid ester and a mono- or di-(hydroxyhydrocarbyl) amine $$RCON(R''OH)_{2-a}(H)_a$$

wherein

R is an alkyl hydrocarbon group containing 6–20 carbon atoms;

R″ is a divalent hydrocarbon group containing 1–10 carbon atoms; and a is 0 or 1.

21. A motor fuel composition comprising (a) a major portion of fuel consisting essentially of a hydrocarbon boiling in the gasoline boiling range; and (b) a minor effective amount of about 0.02–0.2 w% as a detergent additive of a reaction product of (i) as a $C_6$–$C_{20}$ fatty acid ester, a natural oil selected from the group consisting of coconut oil, babasu oil, palm kernel oil, palm oil, olive oil, castor oil, peanut oil, rape oil, beef tallow oil, lard oil, whale blubber oil, and sunflower oil and (ii) a mono- or di-(hydroxy hydrocarbyl amine.

22. A motor fuel composition comprising (a) a major portion of fuel consisting essentially of a hydrocarbon boiling in the gasoline boiling range; and (b) a minor effective amount of about 0.02–0.2 w% as a detergent additive of a reaction product of coconut oil and an ethanolamine.

23. A motor fuel composition as claimed in claim 22 wherein said coconut oil is crude coconut oil.

24. A motor fuel composition as claimed in claim 22 wherein said ethanolamine is ethanolamine or diethanolamine.

25. A motor fuel composition comprising (a) a major portion of fuel consisting essentially of a hydrocarbon boiling in the gasoline boiling range; and (b) a minor effective amount of about 0.02–0.2 w% as a detergent additive of a reaction product of coconut oil and diethanolamine.

* * * * *

UNITED STATES PATENT AND TRADEMARK OFFICE

CERTIFICATE OF CORRECTION

PATENT NO. : 4,729,769

DATED : March 8, 1988

INVENTOR(S) : R. Schlicht, D. Levin, S. Herbstman, R. Sung

It is certified that error appears in the above-identified patent and that said Letters Patent is hereby corrected as shown below:

Column 1, line 37, cancel " a motor fuel composition comprising ";

Column 1, line 48, before "fatty", insert -- a --; after "amide", cancel the period.

Column 4, lines 54 and 55 and column 5, lines 31 and 33, correct the spelling of -- coconate --;

Column 8, line 38, correct the spelling of -- dimethylaminopropanolamine --.

Column 5, lines 20 and 21, correct the formula to read

-- $H_2C$-OOCR --

Signed and Sealed this

Twelfth Day of May, 1992

*Attest:*

DOUGLAS B. COMER

*Attesting Officer*

*Acting Commissioner of Patents and Trademarks*